United States Patent [19]

Wach

[11] Patent Number: 4,548,854

[45] Date of Patent: Oct. 22, 1985

[54] CEILING PRODUCT

[75] Inventor: Thaddeus F. Wach, Macon, Ga.

[73] Assignee: Armstrong World Industries, Inc., Lancaster, Pa.

[21] Appl. No.: 709,934

[22] Filed: Mar. 8, 1985

Related U.S. Application Data

[63] Continuation-in-part of Ser. No. 532,746, Sep. 16, 1983, abandoned.

[51] Int. Cl.[4] ..... B32B 27/12; B32B 33/00; E04B 1/84; E04B 5/52

[52] U.S. Cl. ..... 428/138; 52/144; 181/290; 181/293; 181/294; 106/268; 106/271; 427/387; 427/393.4; 428/290; 428/291; 428/311.1; 428/319.3; 428/447; 428/484

[58] Field of Search ..... 181/290, 294, 293; 427/387; 428/138, 290, 291, 311.1, 319.3; 52/144

[56] References Cited

U.S. PATENT DOCUMENTS 2,604,411 7/1952 Riddell et al. .
2,915,450 12/1959 Olson .
3,204,380 9/1965 Smith et al. .

OTHER PUBLICATIONS

Lawerence, Industrial Waxes, 2nd Edit., Wiley and Sons, New York, N.Y., p. 258.

*Primary Examiner*—James C. Cannon

[57] ABSTRACT

An improved ceiling panel especially useful in mobile residential or commercial structures is provided wherein said ceiling panel has on one surface (usually the back surface) a moisture barrier comprising a cured coating of an aqueous emulsion of slack wax, an emulsifier of triethanolamine and stearic acid, and silicone.

8 Claims, No Drawings

CEILING PRODUCT

RELATED APPLICATION

This application is a continuation-in-part of prior Application Ser. No. 532,746, filed Sept. 16, 1983 for Ceiling Product, and now abandoned.

FIELD OF THE INVENTION

The present invention relates to architectural building products and, more particularly, is directed to a decorative ceiling panel of fiber construction having a moisture barrier on one side thereof.

BACKGROUND OF THE INVENTION

Building products of fiber construction have achieved wide use as decorative ceiling panels in both domestic and commercial buildings. For example, ceiling panels of fiber construction having one surface bearing a decorative design effect such as indentations or fissures and which are painted, usually white, provide an aesthetically pleasing surface and have become widely used as ceiling elements in both residential and commercial structures.

One problem associated with the aforementioned decorative ceiling panels relates to staining of the decorative or face surface of the ceiling panel, especially in high moisture environments. The staining problem is especially acute when decorative ceiling panels are used in the ceiling construction of mobile home structures. For example, mobile type residential or commercial structures have a higher occupancy factor in terms of inhabitants per unit of living space and, as a consequence, a greater volume of moisture vapor is generated in such structures. The increased moisture vapor penetrates through the ceiling structure and condense on colder structural members. Also, mobile type residential or commercial structures are usually constructed to provide a shallow space or plenum between the roof element and the interior ceiling structure thereof. Ordinary air usually occupies the plenum, and the plenum air is normally subjected to rather high temperatures during the daytime hours, followed by much lower temperatures during night-time hours. The wide temperature fluctuations of the plenum air causes considerable condensation of moisture onto the surface of the decorative ceiling panels which faces the plenum area. As a result, moisture accumulated on a panel penetrates through the fibrous body of the ceiling panel and ultimately causes staining of the decorated surface of the ceiling panel due to water soluble, colored materials in the fibrous body of the ceiling panel. The resulting stains discolor the face of the ceiling panel and diminish its otherwise aesthetically pleasing qualities.

Various attempts have been made to apply waterproofing coatings to ceiling panels of fiber construction to minimize absorption of water or water vapor. To illustrate, U.S. Pat. No. 3,204,380 discloses the application of a coating of paraffin wax and low molecular weight polyethylene to the back of an acoustical tile structure to provide a nonstick, waterproof coating.

SUMMARY OF THE INVENTION

According to the present invention, there is provided a ceiling panel of fiber construction having a decorative surface adapted to face a room environment and a second surface adapted to face a plenum area wherein said second surface has a moisture barrier comprising a coating of an aqueous emulsion consisting essentially of slack wax, an emulsifier of triethanolamine and stearic acid, and a silicone resin.

According to the present invention there is further provided a method for moisture-proofing a ceiling panel having a decorative surface adapted to face a room environment and a second surface adapted to face a plenum area by applying to said second surface an aqueous emulsion comprising a slack wax, triethanolamine and stearic acid, and a silicone resin, and thereafer drying said ceiling panel whereby to obtain a ceiling panel having a moisture barrier on said second surface thereof. Preferably, the aqueous emulsion is applied to the ceiling board by roll coating and at a temperature above about 100° F., e.g., 125° to 130° F.

DETAILED DESCRIPTION AND PREFERRED EMBODIMENT OF THE INVENTION

The ceiling panel of the present invention is composed of fibrous material, preferably vegetable or mineral fiber, as is conventional in the industry. The ceiling panel is made by mixing the fibrous material with suitable finely divided filler materials and binder materials, all of which are dispersed usually in water to form a slurry which is processed in a conventional manner as on a papermaking Fourdrinier machine or a vacuum drum to produce a felted product of desired thickness which is subsequently dried in a heated oven. The dry felted product is thereafter subjected to any of several desired finishing operations as, for example, sanding to smooth the surfaces thereof, cutting and painting to provide a panel useful as a ceiling member. More specific disclosures of ceiling panels and methods or processes for making such panels are contained in, for example, U.S. Pat. Nos. 2,995,198; 3,214,565 and 3,771,213.

The present invention provides an improved ceiling panel having a moisture barrier on one surface to prevent or significantly reduce staining of the decorative and painted surface of the panel. The moisture barrier is formed by applying to one surface of the ceiling panel an aqueous emulsion of slack wax, an emulsifier of triethanolamine and stearic acid, and a silicone resin. The emulsion is comprised of up to about 60% by weight of slack wax, up to about 10% by weight of an emulsifier comprising triethanolamine and stearic acid (wherein the weight ratio of triethanolamine to stearic acid is preferably 1:1 but can be from 0.5 to 1 up to 2:1 or 3:1) and up to 5% by weight of a silicon resin (e.g., a silicon emulsion of polymethylsiloxane such as that available from General Electric Co. under the designation GE-SM2138), and the balance being water. Preferably, the aqueous emulsion is applied to the surface of the ceiling panel at a solids concentration of about 40% by weight and at an application rate to provide up to about 15 grams per square foot of the wax emulsion on the surface of the ceiling panel. Most preferably, the wax emulsion is applied on the ceiling panel at a rate of about 7 grams per square foot. All percentages specified herein are intended to be on a weight basis, based upon the total weight of the emulsion, unless otherwise specified. A suitable aqueous emulsion of slack wax and triethanolamine with stearic acid is available under the tradename "Clear End Sealer" from South States Chemical Company, Columbus, Georgia. The "Clear End Sealer" emulsion can be used full strength, but is preferably reduced with water to a viscosity of about 20 seconds in a No. 2 Zahn Cup. The slack wax component of the aqueous emulsion of the inventin is an unfinished wax of the mineral type derived from petroleum and is readily available from numerous petroleum companies such as Exxon Company, U.S.A. The Exxon Company sells four grades of unfinished slack wax, of which Grade 3669 is especially preferred.

The aqueous slack wax emulsion can be applied to the ceiling panel by any suitable method such as roll coating or spraying, roll coating being preferred. The aqueous slack wax emulsion may be applied at room temperature to either a hot or cold ceiling panel. Preferably, the slack wax emulsion is roll coated onto a ceiling panel having a surface temperature above 100° F. (e.g., 120° F. to 130° F.). This can conveniently be done after the ceiling board exits the drying oven during its manufacture. To illustrate, after leaving the drying oven, the ceiling panel is at a temperature of about 130° C. and the panel is conveyed over a roll coater comprising a cylinder roll which rotates through a coating pan that contains the aqueous emulsion of slack wax and deposits the aqueous slack wax emulsion onto the surface of the ceiling panel in contact therewith.

After coating with the slack wax emulsion, the coated ceiling panel is dried either at room temperature or, preferably, in an oven at any suitable temperature, e.g., 75° F. to 100° F.

The dried aqueous emulsion of slack wax, triethanolamine and stearic acid, and silicone provides a highly efficient and effective moisture barrier on the ceiling panel. The following test has been conducted on coated and uncoated ceiling panels to confirm the functionality and unexpectedly superior performance of the moisture barrier provided by the present invention:

MOISTURE GUARD TEST

The Moisture Guard Test is conducted on a sample specimen of a finished ceiling panel having a 12 inch square dimension by applying a suitable caulk or hot melt adhesive on the back of the panel in the form of a ring having a diameter of about 9 inches whereby to provide a circular dam for containing 80 milliliters of water that is poured onto the surface of the ceiling board and within the surface area circumscribed by the dam. The water is allowed to remain on the surface of the ceiling panel at room temperature for 24 hours, after which any water remaining on the ceiling panel is removed and the face of the panel is examined for wetting and staining. After completion of the examination, 80 milliliters of water is again placed on the surface of the ceiling panel and allowed to remain thereon for another 24 hour period. The test procedure is repeated for a total of four cycles.

COMPARATIVE SAMPLES

The Moisture Guard Test was conducted on sample specimens of finished ceiling panels that did not contain a coating of the aqueous wax emulsion. The Comparative Sample specimens were identical in all respects to the coated samples except that the Comparative Samples contained an ordinary internal sizing of paraffin wax and an ordinary coating of a clay and starch emulsion that had been used commercially prior to the wax emulsion coating of the present invention.

EXAMPLE 1

The Moisture Guard Test results of sample specimens of finished ceiling panels having a wax emulsion coating according to the invention and of the Comparative Samples are presented in Table A below.

TABLE A

| Sample No. | Wax Emulsion Coating | Internal Paraffin Wax Content % | Test Cycle When Stained | Stain* % |
|---|---|---|---|---|
| 1 | Yes | 0 | None | 0 |
| 2 | Yes | 0 | None | 0 |
| 3 | Yes | 0 | None | 0 |
| 4 | Yes | 0 | None | 0 |
| 5 | Yes | 0 | None | 0 |
| 6 | Yes | 0 | None | 0 |
| 7 | Yes | 0 | None | 0 |
| 8 | Yes | 0 | None | 0 |
| 9 | Yes | 0 | 3rd | 3 |
| 10 | Yes | 0 | None | 0 |
| 11 | No | 0.2 | 1st | 100 |
| 12 | No | 0.8 | 1st | 100 |
| 13 | No | 1.5 | 1st | 93** |

*Area of stain based upon total surface area of panel specimen.
**Average of 3 trials wherein % stain of each trial was 100%, 100% and 80%, respectively.

The test results in Table A illustrate the vastly superior Moisture Guard performance achieved with the wax emulsion coated ceiling panels of the present invention, especially when compared to the results of similar ceiling panels which do not have the wax emulsion coating of the present invention.

EXAMPLE 2

Additional sample specimens of ceiling panels were coated utilizing wax emulsions of the invention having varying concentrations of solids to achieve deposition of different amounts of the wax emulsion on the ceiling panel specimens, as indicated in Table B below.

TABLE B

| Sample Number | Coating Emulsion: Percent Solids | Amount Deposited on Sample gms/ft$^2$: Wet | Amount Deposited on Sample gms/ft$^2$: Dry | Moisture Guard Test, % Stain At End of 4th Cycle |
|---|---|---|---|---|
| 1 | 47.2 | 8 | 3.78 | 0 |
| 2 | 40.0 | 8 | 3.20 | 0 |
| 3 | 35.0 | 8 | 2.80 | 0 |
| 4 | 30.0 | 8 | 2.40 | 0 |
| 5 | 25.0 | 8 | 2.00 | 0 |
| 6 | 20.0 | 8 | 1.60 | 5 |

The test results in Table B indicate that staining of the ceiling panel specimens occurred when 1.60 grams per square foot of coating emulsion was applied to the ceiling panel, but that staining does not occur when the coating emulsion is applied in amounts of 2.0 grams per square foot or higher.

What is claimed is:

1. A ceiling panel of fibrous construction having a decorative surface adapted to face a room environment and a second surface adapted to face a plenum area wherein said second surface has a moisture barrier comprising about 2 grams per square foot of a dried coating of an aqueous emulsion consisting essentially of a slack wax and triethanolamine with stearic acid, and an amount of silicone resin, the upper limit of which is 5% by weight of the total emulsion weight.

2. The ceiling panel of claim 1 wherein said aqueous emulsion comprises up to about 60% by weight of slack wax and up to about 10% by weight of the emulsifier of triethanolamine and stearic acid.

3. The ceiling panel of claim 2 wherein the weight ratio of triethanolamine-to-stearic acid ranges between 0.5:1 to 3:1.

4. A method for moisture-proofing a ceiling panel of fiber construction comprising applying to one surface of said panel an aqueous emulsion consisting essentially of a slack wax, triethanolamine and stearic acid, and an amount of silicone resin, the upper limit of which is 5% by weight of the total emulsion weight, and thereafter drying said coated ceiling panel.

5. The method of claim 4 wherein said aqueous emulsion comprises up to about 60% by weight of slack wax and up to about 10% by weight of the emulsifier of triethanolamine and stearic acid.

6. The method of claim 4 wherein said coated panel is dried at a temperature up to 125° F.

7. The method of claim 6 wherein said aqueous emulsion comprises up to about 60% by weight of slack wax and up to about 10% by weight of the emulsifier of triethanolamine and stearic acid.

8. The method of claim 7 wherein the weight ratio of triethanolamine-to-stearic acid ranges between 0.5:1 to 3:1.

* * * * *